US006105276A

United States Patent [19]

Ensign et al.

[11] Patent Number: 6,105,276

[45] Date of Patent: Aug. 22, 2000

[54] LIMITING ORIFICE DRYING MEDIUM, APPARATUS THEREFOR, AND CELLULOSIC FIBROUS STRUCTURES PRODUCED THEREBY

[75] Inventors: Donald Eugene Ensign, Cincinnati; Robert Charles Dreisig; Michael Gomer Stelljes, Jr., both of West Chester, all of Ohio; Wilbur Russell Knight, Franklinton, La.

[73] Assignee: The Procter & Gamble Company, Cincinnati, Ohio

[21] Appl. No.: 08/878,794

[22] Filed: Jun. 19, 1997

[51] Int. Cl.[7] ..... F26B 3/00

[52] U.S. Cl. ..... 34/453; 34/116; 442/6; 442/45; 442/203; 442/212; 442/255; 428/198

[58] Field of Search ..... 428/198; 442/6, 442/45, 203, 212, 255; 34/116, 453

[56] References Cited

U.S. PATENT DOCUMENTS

| | | | |
|---|---|---|---|
| Re. 28,459 | 7/1975 | Cole et al. | 34/6 |
| 4,172,910 | 10/1979 | Rotar | 427/243 |
| 4,251,928 | 2/1981 | Rotar et al. | 34/116 |
| 4,329,201 | 5/1982 | Bolton | 162/198 |
| 4,528,239 | 7/1985 | Trokhan | 428/247 |
| 4,556,450 | 12/1985 | Chuang et al. | 162/204 |
| 4,583,302 | 4/1986 | Smith | 34/116 |
| 4,637,859 | 1/1987 | Trokhan | 162/109 |
| 4,888,096 | 12/1989 | Cowan et al. | 162/358 |
| 4,921,750 | 5/1990 | Todd | 428/225 |
| 4,942,675 | 7/1990 | Sundovist | 34/23 |
| 4,973,385 | 11/1990 | Jean et al. | 162/368 |
| 5,274,930 | 1/1994 | Ensign et al. | 34/23 |
| 5,581,906 | 12/1996 | Ensign et al. | 34/453 |
| 5,598,643 | 2/1997 | Chuang et al. | 34/406 |

*Primary Examiner*—Marion McCamish
*Assistant Examiner*—Ula C. Ruddock
*Attorney, Agent, or Firm*—Larry L. Huston; E. Kelly Linman; Jacobus C. Rasser

[57] ABSTRACT

A limiting orifice through-air-drying medium for papermaking or other absorbent embryonic webs. The medium may be used in an apparatus which can be embodied in a cover and a roll. The medium has the unique combination of a relatively high bending fatigue strength and relatively low pressure drop. The medium may comprise a laminate of a plurality of plies. The intermediate plies of the laminate may be woven with a square weave. The medium may also be used for other types of drying.

15 Claims, 1 Drawing Sheet

LIMITING ORIFICE DRYING MEDIUM, APPARATUS THEREFOR, AND CELLULOSIC FIBROUS STRUCTURES PRODUCED THEREBY

FIELD OF THE INVENTION

The present invention relates to an apparatus for through air drying, particularly to an apparatus which limits the drying airflow through a cellulosic fibrous structure and to absorbent embryonic webs which are through air dried thereon.

BACKGROUND OF THE INVENTION

Absorbent embryonic webs are a staple of everyday life. Absorbent embryonic webs include cellulosic fibrous structures, absorbent foams, etc. Cellulosic fibrous structures have become a staple of everyday life. Cellulosic fibrous structures are found in facial tissue, toilet tissue and paper toweling.

In the manufacture of cellulosic fibrous structures, a wet embryonic web of cellulosic fibers dispersed in a liquid carrier is deposited onto a forming wire. The wet embryonic web may be dried by any one of or combinations of several known means. Each of these known drying means will affect the properties of the resulting cellulosic fibrous structure. For example, the drying means and process of drying can influence the softness, caliper, tensile strength, and absorbency of the resulting cellulosic fibrous structure. Importantly, the means and process used to dry the cellulosic fibrous structure also affects the rate at which it can be manufactured, without being rate limited by such drying means and process.

An example of one drying means is felt belts. Felt drying belts have long been used to dewater an embryonic cellulosic fibrous structure through capillary flow of the liquid carrier into a permeable felt medium held in contact with the embryonic web. However, dewatering a cellulosic fibrous structure with a felt belt results in overall uniform compression and compaction of the embryonic cellulosic fibrous structure web to be dried.

Felt belt drying may be assisted by a vacuum, or may be assisted by opposed press rolls. The press rolls maximize the mechanical compression of the felt against the cellulosic fibrous structure. Examples of felt belt drying are illustrated in U.S. Pat. No. 4,329,201 issued May 11, 1982 to Bolton and U.S. Pat. No. 4,888,096 issued Dec. 19, 1989 to Cowan et al.

Drying a cellulosic fibrous structure via capillary flow, using a porous cylinder having preferential pore sizes is known in the art as well. Examples of such capillary flow drying techniques are illustrated in commonly assigned U.S. Pat. No. 4,556,450 issued Dec. 3, 1985 to Chuang et al., incorporated herein by reference, U.S. Pat. No. 5,598,643, issued Feb. 4, 1997 in the names of Chuang et al., and U.S. Pat. No. 4,973,385 issued Nov. 27, 1990 to Jean et al.

Drying cellulosic fibrous structures through vacuum dewatering, without the aid of felt belts is known in the art. Vacuum dewatering of the cellulosic fibrous structure mechanically removes moisture from the cellulosic fibrous structure using vacuum shoes and vacuum boxes. The vacuum deflects discrete regions of the cellulosic fibrous structure into the drying belt. Preferably the drying belt is a through air drying belt having a resinous patterned framework with deflection conduits therethrough, as disclosed in commonly assigned U.S. Pat. No. 4,637,859 issued to Trokhan and incorporated herein by reference. Vacuum dewatering on such a belt produces a multi-region cellulosic fibrous structure having a high density essentially continuous network and discrete low density regions distributed therein.

Dewatering with such a belt yields a cellulosic fibrous structure having different amounts of moisture in the two aforementioned regions. The different amounts of moisture in the different regions of the cellulosic fibrous structure can rate limit the papermaking process. Such limitation occurs because the two regions will dry at different rates. The region having the slower drying rate will then control the overall rate of the papermaking process.

In yet another drying process, considerable success has been achieved by through-air drying the embryonic web of a cellulosic fibrous structure. In a typical through-air drying process, a foraminous air permeable belt supports the embryonic web to be dried. Air flow passes through the cellulosic fibrous structure and through the permeable belt. The air flow principally dries the embryonic web by evaporation. Regions coincident with and deflected into the foramina of the air permeable belt are preferentially dried and the caliper of the resulting cellulosic fibrous structure is increased. Regions coincident the knuckles in the air permeable belt are dried to a lesser extent.

Several modifications and improvements to the air permeable belts used for through-air drying have been accomplished in the art. For example, the air permeable belt may be made with a relatively high open area. Or, the belt may be made to have reduced air permeability. Reduced air permeability may be accomplished by applying a resinous mixture to obturate the interstices between woven yarns in the belt. The drying belt may be impregnated with metallic particles to increase its thermal conductivity and reduce its emissivity. Preferably, the drying belt is constructed from a photosensitive resin comprising a continuous network. The drying belt may be specially adapted for high temperature airflows. Examples of such through-air drying technology are found in U.S. Pat. No. Re. 28,459 reissued Jul. 1, 1975 to Cole et al.; U.S. Pat. No. 4,172,910 issued Oct. 30, 1979 to Rotar; U.S. Pat. No. 4,251,928 issued Feb. 24, 1981 to Rotar et al.; commonly assigned U.S. Pat. No. 4,528,239 issued Jul. 9, 1985 to Trokhan; and U.S. Pat. No. 4,921,750 issued May 1, 1990 to Todd.

Additionally, several attempts have been made in the art to regulate the drying profile of the cellulosic fibrous structure while it is still an embryonic web to be dried. Such attempts may use either the drying belt, or an infrared dryer in combination with a Yankee hood. Examples of profiled drying are illustrated in U.S. Pat. No. 4,583,302 issued Apr. 22, 1986 to Smith and U.S. Pat. No. 4,942,675 issued Jul. 24, 1990 to Sundovist.

The foregoing art, even that specifically addressed to through-air drying, does not address the problems encountered when drying a multi-region cellulosic fibrous structure. As noted above, different regions of through air dried paper have different moisture contents. But a first region of the cellulosic fibrous structure, having a lesser density or basis weight than a second region, will typically have relatively greater airflow therethrough than the second region will have. This relatively greater airflow occurs because the first region of lesser density or basis weight presents proportionately less flow resistance to the air passing through the embryonic web than the second region. Such differential air flow does not offset, and may even increase, the differential moisture contents of the different regions.

This problem is exacerbated when the multi-region cellulosic fibrous structure to be dried is transferred to a Yankee drying drum. On a Yankee drying drum, only certain regions of the cellulosic fibrous structure contact the circumference of a heated cylinder. Typically the most intimate contact with the Yankee drying drum occurs at the high density or high basis weight regions. These regions have more moisture than the low density or low basis weight regions.

Hot air from a hood may be introduced to the surface of the cellulosic fibrous structure opposite the heated cylinder. Preferential drying of this surface of the cellulosic fibrous structure occurs by convective transfer of the heat from the airflow in the Yankee drying drum hood. To allow complete drying of the high density and high basis weight regions of the cellulosic fibrous structure to occur and to prevent scorching or burning of the already dried low density or low basis weight regions by the air from the hood, the Yankee hood air temperature must be decreased and/or the residence time of the cellulosic fibrous structure in the Yankee hood must be increased, slowing the production rate. Accordingly, the production rate of the cellulosic fibrous structure must be slowed, to compensate for the greater moisture in the high density or high basis weight region.

One improvement in the art which addresses this problem is illustrated by commonly assigned U.S. Pat. No. 5,274,930 issued Jan. 4, 1994 to Ensign et al. and disclosing limiting orifice drying of cellulosic fibrous structures in conjunction with through-air drying, which patent is incorporated herein by reference. This patent teaches an apparatus utilizing a micropore drying medium which has a greater flow resistance than the interstices between the fibers of each region of the cellulosic fibrous structure. The micropore medium is the limiting orifice in the through-air drying process, so that a more uniform moisture distribution is achieved in the drying process.

Yet a further improvement to the apparatus disclosed in Ensign et al. '930 is the apparatus disclosed in commonly assigned U.S. Pat. No. 5,581,906 issued Dec. 10, 1996 to Ensign at al. and incorporated herein by reference. Ensign et al. '906 discloses a micropore drying apparatus having multiple zones and which more efficiently dries the cellulosic fibrous structure than the types of apparatus disclosed in the prior art.

The foregoing micropore drying apparatuses should desirably provide a medium which both limits the air flow through the cellulosic fibrous structure and has sufficient bending fatigue strength to withstand the cyclic loading inherent to papermaking with the claimed apparatus. For example, the medium may be executed as the covering of an axially rotatable roll. As the roll and medium are rotated, any portion of the medium alternately receives both positive and negative pressure loads. Reversing the loading from positive to negative cycles the medium with an alternating stress that must be withstood by the medium. Thus, the medium must have adequate bending fatigue strength, to withstand this cyclic loading.

One solution to the problem of providing adequate bending fatigue strength might be to simply to make the medium stronger. However this solution, without more, brings other problems. As the medium becomes stronger, it typically becomes thicker and may have less open area. A medium having less open area encounters a greater pressure drop than a medium having relatively more open area. The benefits of minimizing pressure drop are known and discussed in the aforementioned Ensign et al. '906 patent. Furthermore, as the medium becomes thicker, it also becomes more difficult to fabricate.

Accordingly, it is an object of this invention to provide a medium for use with a micropore apparatus particularly the apparatus of the aforementioned Ensign et al '906 and the Ensign et al. '930 patents. It is also an object of the present invention to provide a medium usable with the capillary dewatering apparatus, such as the apparatuses of the aforementioned Chuang et al. '450 patent or the aforementioned Chuang et al. '305 application. It is also an object of the present invention to provide a medium usable with conventional felt dewatering and through air drying.

It is further an object of this invention to provide such a medium which provides both adequate bending fatigue strength and a relatively small pressure drop. Particularly, it is an object to provide such a medium that has a relatively small pressure drop.

SUMMARY OF THE INVENTION

The invention comprises a generally planar drying medium. The drying medium comprises a plurality of plies juxtaposed together in face-to-face relationship. The medium has a bending fatigue strength of at least 25 pounds per inch and a pressure drop of less than 70 inches of water at a flow of 800 standard cubic feet per minute per square foot.

The medium may comprise a fine first ply. The fine first ply may be a woven metal cloth. The fine first ply may have a Dutch twill weave. The first ply may have a nominal pore size of 20 microns or less. Opposite the first ply is the coarsest ply of the medium. The coarsest ply of the medium may also comprise a woven cloth or be a perforated metal plate. Intermediate the first and coarsest plies are at least one intermediate plies. The intermediate plies may comprise a square weave.

DETAILED DESCRIPTION OF THE INVENTION

Figure 1:
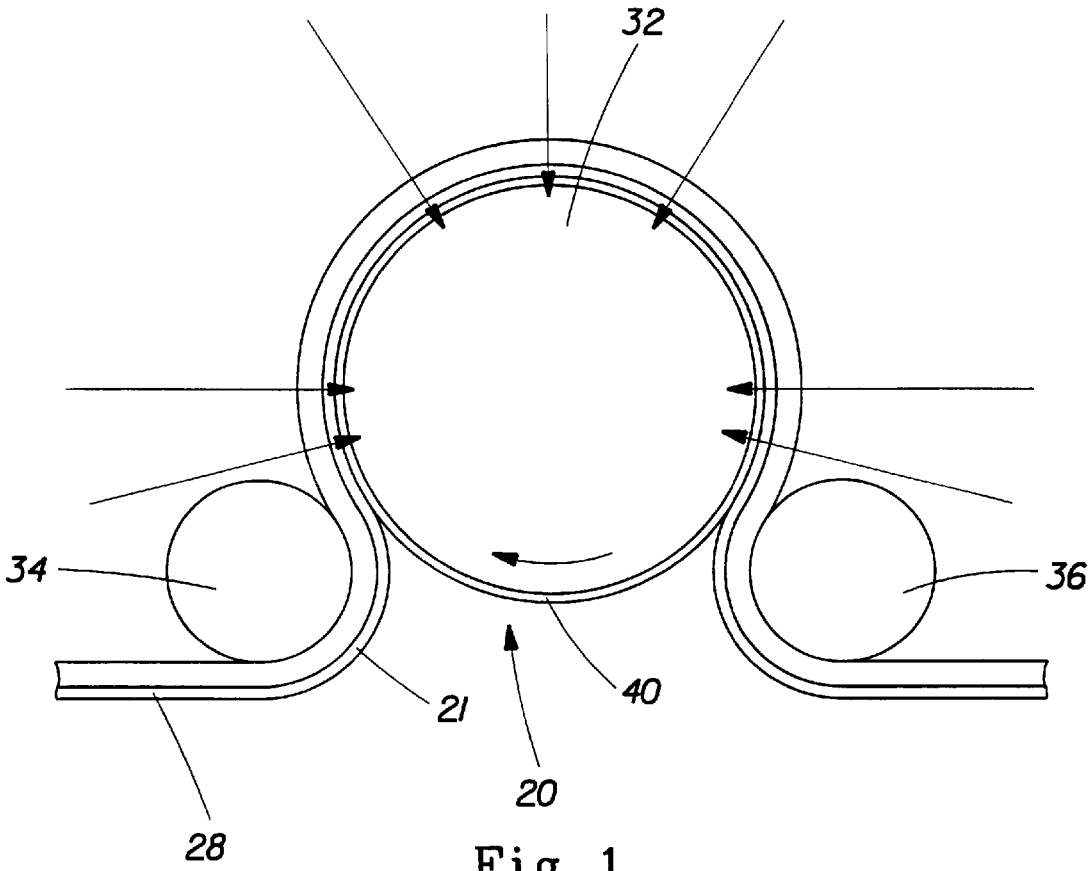
FIG. 1 is a schematic side elevational view of an apparatus according to the present invention.
Figure 2:
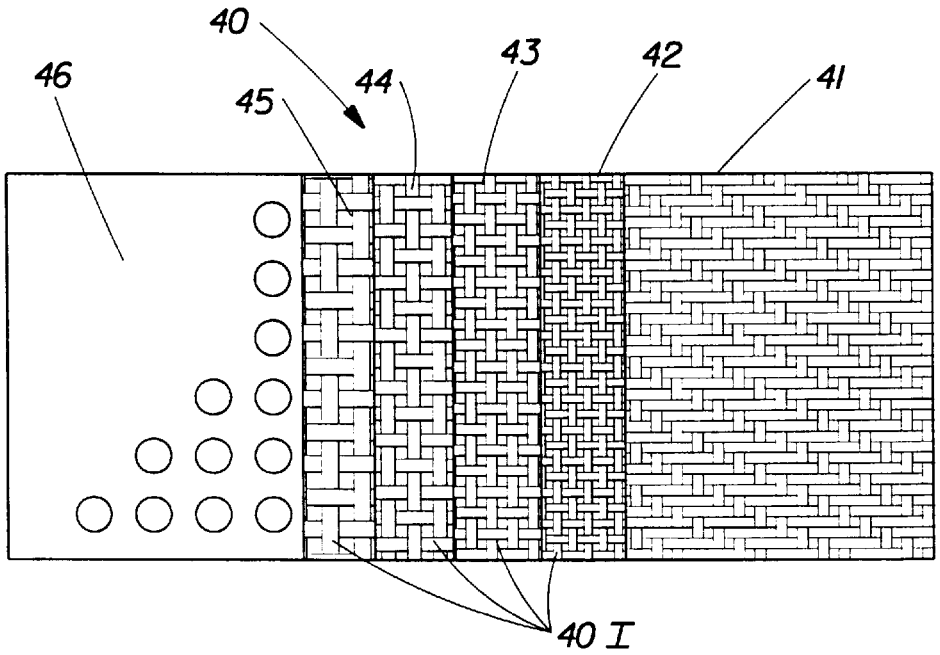
FIG. 2 is a fragmentary top plan view of a medium according to the present invention, shown partially in cutaway.

Referring to FIG. 1, the present invention comprises a micropore drying medium 40 for a limiting orifice though-air-drying apparatus 20. The apparatus 20 and medium 40 may be generally made and operated according to the aforementioned commonly assigned U.S. Pat. Nos. 5,274,930 and 5,581,906, the disclosures of which are incorporated herein by reference. The apparatus 20 removes moisture from an embryonic web 21. The apparatus 20 may comprise a pervious cylinder 32. The micropore medium 40 circumscribes such a pervious cylinder 32 and is preferably attached thereto with a shrink fit, a press fit, threaded fasteners, brazing, etc. It will be recognized other executions of the apparatus 20 and medium 40 may be feasible. For example, the apparatus 20 may comprise a partitioned vacuum slot or the medium 40 may comprise an endless belt A support member 28, such as a through-air-drying belt, wraps the pervious cylinder 32 from an inlet roll 34 to a takeoff roll 36, subtending an arc defining a circular segment. This circular segment may be subdivided into multiple zones having mutually different differential pressures relative to the ambient atmospheric pressure. The web 21 to be dried is sandwiched between the support member 28 and the medium 40.

The micropore medium 40 according to the present invention may comprise a laminate of multiple plies 41–46. A medium 40 having six plies 41–46 will be discussed below, although it is to be understood the invention is not so limited. A medium having any plurality of plies 41–46 and meeting the bending fatigue strength and pressure drop criteria discussed below is suitable for the present invention.

The medium 40 according to the present invention has a bending fatigue strength of at least 25, preferably at least 50, and more preferably at least 75 pounds per inch. Bending fatigue strength is measured according to the following procedure.

A sample having dimensions of 1 inch wide×2 inches long is provided. The long direction of the sample corresponds to the machine direction during papermaking. The sample is scored, in the width direction, across the center of the first ply 41. Scoring is accomplished with a carbide tipped Scratchall, using hand pressure. The score line should be approximately halfway through the thickness of the first ply 41.

A three point bending test apparatus is provided. The apparatus has a fixture comprising two vertically oriented supports onto which the sample to be tested is placed. The apparatus further has a movable crosshead capable of applying a downward load at a position halfway between the two supports. The supports have a width of at least 1 inch and a ⅛ inch radius. The supports have a free span therebetween of 0.750 inches.

The sample to be tested is placed in the apparatus and oriented so that the first ply 41 is in tension and disposed away from the head which applies the variable downward load. The sample is simply supported on the two supports. The score line is centered between the supports. A variable downward load is applied to the sample, at midpoint between the supports and directly opposite the score line.

The load is applied in sine wave form at a frequency of 3 Hertz. The load is cycled between a maximum load value and a value of 1/10 the maximum, to provide an R-ratio of 0.10. Three different maximum load values are used. The magnitudes of the maximum load values are dependent upon the 0.2 percent offset bending strength of the sample.

The deflection of the sample under the first load cycle in the bending fatigue strength testing is measured. The deflection may be measured by an extensometer and dial gauge as is known in the art. Suitable equipment is made by the Mechanical Testing Systems Company of Edon Prairie, Minn. and sold as MTS Model 632. The sample being tested is judged to have failed when the deflection at any given cycle is twice the deflection of the first cycle.

The 0.2 percent offset bending strength may be found generally in accordance with ASTM D790–92, Method 1, modified as follows. A 1×2 inch sample of the medium 40 is provided. The sample (no score line) is loaded into the aforementioned three point bend test apparatus and tested one time in bending at a crosshead speed of 0.02 inch per minute until plastic deformation occurs.

The bending strength at a 0.2 percent offset is then found. The 0.2 percent offset bending strength is then found by drawing a straight line parallel to the linear portion of the bending stress/strain curve, and offset from the origin, on the abscissa 0.0015 inches (0.2 percent of the 0.750 inch span). The 0.2 percent offset bending strength at the 0.2 percent offset is found, as the intersection of this line and the bending load vs. deflection curve. The three samples are tested this way, and the results averaged to give a single 0.2 percent offset bending strength datum point.

The values corresponding to 60, 85 and 110 percent of the 0.2 percent offset bending strength are found. Thus, three values are utilized for the maximum load values in the bending fatigue strength determination, i.e., 0.60, 0.85 and 1.10 of the 0.2 percent offset bending strength.

Three fatigue tests are run to failure, as described above. Each of the fatigue tests utilizes one of the three aforementioned maximum load values, each load being a multiple of 0.60, 0.85 and 1.10 of the 0.2 percent offset bending strength. Three samples are run at each of the three specified loads, for a total of nine samples. For each maximum load value, the three data points are averaged to give a single datum point.

The three resulting data points are plotted on a semi-log curve displaying load versus number of cycles, as is known in the art. The bending fatigue strength is then the asymptote of the curve through the three data points. The curve takes the general form $Y=AX^{-0.5}+B$, wherein B is this asymptote. The asymptote of the curve corresponds to the bending fatigue strength for the three data points under consideration. While one of ordinary skill will know mathematical techniques to solve this equation for B, the bending fatigue strength is most easily found using any regression program common to most engineering software programs. A suitable program is Excel, sold by Microsoft Corporation of Redmond, Wash.

The medium 40 according to the present invention also has a dry pressure drop of less than 70, preferably less than 50, and more preferably less than 30 inches of water. Pressure drop is measured as follows.

A suitably sized sample of the medium 40 is clamped in a test chamber so that a four inch diameter section of the medium 40 is exposed to airflow therethrough. The test apparatus comprises a length of pipe 7 inches long and having a two inch nominal inside diameter. The inside diameter of the pipe then tapers at a 7° included angle over a 16 inch length to a 4 inch nominal inside diameter. The sample of the medium 40 is then clamped at the 4 inch nominal inside diameter portion of the apparatus. Downstream of the sample 40 the apparatus again tapers at an included angle of 7° from a 4 inch nominal inside diameter to a 2 inch nominal inside diameter. This 2 inch inside diameter section of the test apparatus is also at least 7 inches long and straight. The medium 40 is oriented so that the first ply 41 faces the high pressure (upstream) side of the airflow.

Eight hundred scfm per square feet airflow is applied through the medium 40 for a total of about 70 scfm for the sample described herein. The static pressure across the sample is measured by a manometer, a pair of pressure transducers, or other suitable means known in the art.

A comparison of various prior art media and media 40 according to the present invention is shown in Table I below.

TABLE I

| | Construction | Pressure Drop at 800 SCFM/sqft (inches water) | Bending Fatigue Strength (pounds/inch) |
|---|---|---|---|
| Prior Art I 4 Ply | 325 × 2300 Dutch twill<br>150 × 150 square<br>60 × 60 square<br>12 × 64 plain Dutch | 78 | 10 |
| Prior Art II 5 Ply | 325 × 2300 Dutch twill<br>150 × 150 square<br>60 × 60 square | 100 | 124 |

TABLE I-continued

| | Construction | Pressure Drop at 800 SCFM/sqft (inches water) | Bending Fatigue Strength (pounds/inch) |
|---|---|---|---|
| | 12 × 64 plain Dutch<br>16 gauge perf plate w/23% open area 3/32 inch dia. holes on 3/16 inch pitch | | |
| Prior Art III 4 Ply | 165 × 1400 Dutch twill<br>150 × 150 square<br>60 × 60 square<br>12 × 64 plain Dutch | 30 | 15 |
| Present Invention I 5 Ply | 165 × 1400 Dutch twill<br>150 × 150 square<br>60 × 60 square<br>12 × 64 plain Dutch<br>16 gauge perf plate w/23% open area 3/32 inch dia. holes on 3/16 inch pitch | 51 | N/A |
| Present Invention II 6 Ply | 165 × 1400 Dutch twill<br>150 × 150 square<br>60 × 60 square<br>30 × 30 square<br>16 × 16 square<br>24 gauge perf plate w/ 37% open area and 0.080 inch dia. holes on 0.125 inch pitch | 30 | 65 |
| Present Invention III 6 Ply | 165 × 1400 Dutch twill<br>150 × 150 square<br>60 × 60 square<br>30 × 30 square<br>16 × 16 square<br>24 gauge perf plate w/ 32% open area and 0.065 inch dia. holes on 0.109 inch pitch | approx. 30 | N/A |

If one takes Prior Art I, from Table I as a starting point, it might be easy to believe the low bending fatigue strength problem can be fixed by adding a perforated plate as the last ply 45, resulting in Prior Art II. However, Prior Art II illustrates the trade off between bending fatigue strength and pressure drop. As the bending fatigue strength increases so does the pressure drop—leading to unacceptable operating results. In contrast Prior Art III has an acceptable pressure drop but unacceptable bending fatigue strength.

Thus, it is only with the present invention an acceptable combination of bending fatigue strength and pressure drop results. One should preferably not try to achieve acceptable pressure drop and bending fatigue strength using a very open first ply 41 and a relatively thick perforated plate having a low open area for the last ply 46. Such an embodiment may provide unacceptable dewatering or sheet support. Comparing Prior Art III to Present Invention I indicates that adding a perforated plate to achieve bending fatigue strength also increases pressure drop by about 21 inches of water. It is only with the present invention that going from the 4 layer Prior Art III medium 40 to the 6 layer medium 40 of the present invention that pressure drop remains constant while bending fatigue strength increases to an acceptable value. Present Invention I is expected to have a bending fatigue strength at least as great as that shown in Prior Art II. According to the present invention the combination of plies 42–46 after the first ply 41 adds not more than 5 inches of water to the pressure drop through the medium 40 at 800 scfm per square foot.

As shown above, the medium 40 comprises a plurality of plies ranging from a first ply 41 to a last ply 46. The plies 41–46 of the medium 40 serve three different functions: support for the web 21 made thereon, strength, and as connections between the support plies and strength plies. The connector plies are necessary because the first ply 41 is so fine and deformable, it would deform into the interstices of the strength plies 45–46 without intermediate plies 42–44 as connectors therebetween. Such deformation would break the hydraulic connection between the first ply 41 and the web 21. The intermediate plies 40I maintain the generally planar configuration of the first ply 41.

The plies 41–46 are arranged, preferably from the finest ply 41 to the coarsest ply 46. The finest ply 41 provides support as discussed above. The coarsest ply 46 and possibly one or two plies adjacent the coarsest ply 46 provide strength. The plies 42–44 intermediate the first ply 41 and the strength plies 45–46 provide hydraulic connection therebetween and support for the first ply 41 thereabove. It is important that each ply 41–45 in the medium 40 above the perforated plate 46, be able to provide both perpendicular and lateral fluid flow. Preferably when the plies 40–46 are considered as a unitary assembly for the medium 40, the medium 40 exhibits the pressure drop and bending fatigue strength properties described herein.

The first ply 41 of the medium 40 contacts the web 21. The first ply 41 is typically the finest ply of the medium 40 and has pores or other interstitial flow channels finer than the median interstices in the web 21 to be dried. Preferably the pores of the first ply 41 have a nominal size of 20 microns or less, more preferably 15 microns or less and most preferably, 10 microns or less. Pore size is deduced from SAE Standard ARP 901 issued Mar. 1, 1968, and incorporated herein by reference.

The first ply 41 according to the present invention may have a Dutch twill weave. A Dutch twill weave can be woven with small enough pores to provide a limiting orifice for fluid flow therethrough as the paper made thereon is dried during papermaking. Also, a Dutch twill weave can be woven to provide a small enough pore size for capillary dewatering to occur. A Dutch twill weave has both warps and shutes which alternately pass over two and under two wires in each direction. Alternatively, a square weave may prophetically be used, although it may not have small enough pores.

Also, a broad mesh twill or a broad mesh twill ZZ weave may prophetically be used. Such weaves are illustrated in the Haver and Boecker literature and in U.S. Pat. No. 4,691,744, issued Sep. 8, 1987, to Haver et al. and incorporated herein by reference.

The coarsest ply 46 of the medium 40 may be a perforated plate or a woven metal fabric. This ply 46 is furthest from the web 21. A plate having a continuous support network for the load path is preferred, in order to resist the diametrically applied loads and the hoop stresses encountered when the medium 40 is used for papermaking.

The thickness of the coarsest ply 46 is preferably from about 0.020 to 0.030 inches for the embodiments described herein. If the coarsest ply 46 is too thick, fabrication can become more difficult. If a perforated plate is used for the coarsest medium 46, and the plate is too thin it will likely not be able to meet the bending fatigue strength requirements set forth herein. A portion of the bending fatigue strength not provided by the coarsest ply 46 may be compensated for by providing stronger intermediate plies 42–45. Such an arrangement is generally not as desirable as it increases the pressure drop and may interfere with the flow path for the fluid flow through the medium 40. The perforated plate may have an open area ranging from 20–40%, and more preferably ranging from 30–37%.

The plies 42–45 between the first or finest ply 41 and the coarsest ply 46 are referred to as intermediate plies 40I. The intermediate plies 40I are preferably woven. If the intermediate plies 40I are woven, preferably the specific weave provides an unobstructed flow channel, i.e., a pore, in the direction perpendicular to the plane of that ply 40I through that entire ply 40I. A preferred weave for this ply 40I is a square weave, although a twill square weave will also suffice. A twill square weave has square openings and shutes passing over two and under one or two warps in a diagonal pattern.

A square weave has the warp and shute wires woven in a simple one-over-one or one-under pattern. In the degenerate case the warp and shute wires have identical diameter. The mesh count of a square weave is the same in both directions, and the flow path is straight through, in the direction perpendicular to the plane of that ply 40I. A square weave is preferred for the intermediate plies 40I, because a square weave provides the best balance of two phase fluid flow in the directions perpendicular and lateral to that ply 40I. Compared to a square weave of identical mesh count, the twill weave can utilize larger diameter wires to obtain greater density and strength. A plain Dutch weave utilizes a square weave pattern with warps of larger diameter than the shutes. A reverse plain Dutch weave is also feasible, and has a square weave pattern with shutes of larger diameter than the warps.

Contrary to the teachings of the prior art, it is preferred none of the intermediate plies 40I have a plain Dutch weave. Weaves such as Dutch twill, plain Dutch and reverse plain Dutch weaves, when used for the intermediate plies 40I tend to unduly restrict airflow through the medium 40. In contrast, plain square weaves provide improved drainage for dewatering the web 21. The improved drainage is due to the higher projected open area of the plain weave. If desired, other types of weaves can be utilized, provided that ply 40I has airflow both perpendicular to the medium 40 and lateral, i.e. within the ply 40I.

The plies 41–46 may be joined together to form a unitary medium 40 as follows. First, the intermediate plies 40I are individually calendered. Optionally, the first ply 41 may also be calendered. The calendering must be sufficient to provide adequate knuckle area but not crimp the fibers or unduly reduce the open area of the pores. The calendering is sufficient to reduce the thickness of plies 41–45 to approximately 65 to 80 percent of their original thickness. It will be recognized by one of ordinary skill that a considerable range of calendering levels may be utilized to provide the desired knuckle area. The knuckle area is important in providing adequate peel strength between the plies.

The plies 41–46 are then superimposed upon each other in the desired sequence. As noted above preferably, but not necessarily, the plies are monotonically arranged in order from that ply 41 having the smallest pore size to the ply 46 having the largest pore size.

The plies 41–46 are then sintered to join each ply to the adjacent plies 41–46. Sintering may be performed in accordance with processes used by those of ordinary skill to make filter media, as is known in the art. The sintering operation produces a laminate medium 40 as described herein.

Present Invention I

The following describes the medium 40 listed as Present Invention I, in Table I above. Plies 41–45 of the medium 40 were made from 304L or 316L stainless steel. The last ply 46 was made of 304 stainless steel. The first ply 41 of the medium 40 is very fine, in order to provide the micropores which limit the airflow through the medium 40 and the absorbent embryonic web 21. The first ply 41 comprised a woven metal screen having a 165×1400 Dutch twill weave. The screen was made with 0.0028 inch diameter warp wires and 0.0016 inch diameter shute wires. As noted above, a square weave is not preferred for the first ply 41, so that the first ply 41 will have small enough pores to provide adequate web support, adequate hydraulic connections, and a limiting orifice for air flow through the web 21.

The second ply 42 of the medium 40 is subjacent the first ply 41. The second ply 42 comprises a woven metal fabric having a 150×150 square weave of 0.0026 inch diameter wires, in order to provide adequate support for the first ply 41.

The third ply 43 of the medium 40 is subjacent the second ply 42. The third ply 43 comprises a woven metal fabric having a 60×60 square weave of 0.0075 inch diameter wires.

The fourth ply 44 of the medium 40 is subjacent the third ply 43. The fourth ply 44 comprises a woven metal fabric having a 30×30 square weave of 0.016 inch diameter wires.

The fifth ply 45 of the medium 40 is subjacent the fourth ply 44. The fifth ply 45 comprises a woven metal fabric having a 16×16 square weave of 0.028 inch diameter wires.

The coarsest ply 46 of the medium 40 provides support for the balance of the medium 40. The coarsest ply 46 is a perforated metal plate. For the embodiment described herein, a sixth ply 46 comprising a 24 gage steel plate having a thickness of 0.0239 inches, and approximately a 37 percent open area was found to work well. The approximately 37 percent open area was provided by 0.080 inch diameter holes bilaterally staggered at 60 degrees on a pitch of 0.125 inches. The hole pattern is staggered in a path parallel to the machine direction. As will be recognized by one of ordinary skill, generally for equivalent open areas, a pattern providing a larger number of smaller holes is preferable to a hole pattern comprising a smaller number of relatively larger holes.

The coarsest ply 46 of the medium 40 was the sixth ply 46 in the embodiment described herein. However it is to be recognized that a medium 40 according to the present invention may be made having three to nine plies.

Alternatively, the coarsest ply 46 may comprise a woven fabric. If the coarsest ply 46 is a woven fabric, it may comprise a 12×12 square weave of 0.032 inch diameter wires. It is understood that the 12×12 description designates there are 12 of the wires per inch of direction taken perpendicular to the major length of the wires and the first direction is the warp direction.

The aforementioned above medium 40 is useful for drying an embryonic web 21 having a pulp filtration resistance (PFR) of 5 to 20, and preferably from 10 to 11. Pulp filtration resistance is measured according to the procedure set forth in commonly assigned U.S. Pat. No. 5,228,954 issued Jul. 20, 1993 to Vinson et al., which patent is incorporated herein by reference.

As used herein, a "web" or "cellulosic fibrous structure" refers to structures, such as paper, comprising at least fifty percent cellulosic fibers, and a balance of synthetic fibers, organic fillers, inorganic fillers, foams etc. Suitable cellulosic fibrous structures for use with the present invention can be found in commonly assigned U.S. Pat. Nos. 4,191,609 issued Mar. 4, 1980 to Trokhan; 4,637,859 issued Jan. 20, 1987 to Trokhan; and 5,245,025 issued Sep. 14, 1993 to Trokhan et al., which patents are incorporated herein by reference. As used herein, a web is considered "absorbent" if it can hold and retain water, or remove water from a surface.

The water removal rate for the apparatus 20 according to the present invention is measured in terms of pounds of water removed per pound of fiber divided by the time the fibers are subjected to the process. Mathematically, this can be expressed as water removal rate=(pounds of water removed/pounds of fiber)/time in seconds.

The water removal rate is ascertained by measuring the consistencies of the embryonic web 21 before and after the apparatus 20 using gravimetric weighing and convective drying to achieve a bone-dry baseline.

While the medium 40 and apparatus 20 according to the present invention have been discussed in conjunction with through air drying an embryonic web 21, it is to be recognized the invention described and claimed herein is not so limited. The present invention can also be used in conjunction with felt drying or with capillary drying devices as well.

What is claimed is:

1. A drying medium, said drying medium comprising a plurality of plies joined together in face-to-face relationship, said medium having a bending fatigue strength of at least 25 pounds per inch, and a pressure drop of less than 70 inches of water at a flow rate of 800 standard cubic feet per minute per square foot.

2. A medium according to claim 1 wherein said bending fatigue strength is at least 50 pounds per inch.

3. A medium according to claim 2 wherein said bending fatigue strength is at least 75 pounds per inch.

4. A medium according to claims 1, 2 or 3 wherein said pressure drop is less than 50 inches of water.

5. A medium according to claim 4 wherein said pressure drop is less than 30 inches of water.

6. A drying medium having two opposed faces, said drying medium comprising a plurality of plies, a first ply, said first ply being disposed on one face of said medium, a coarsest ply, said coarsest ply being disposed on said opposite face of said medium, and a plurality of plies intermediate said first ply and said coarsest ply, each of said intermediate plies and said coarsest ply having an unobstructed flow channel perpendicular to said intermediate plies and said coarsest ply.

7. A medium according to claim 6 wherein at least one of said intermediate plies comprises a square weave.

8. A medium according to claim 7 wherein said first ply comprises a Dutch twill weave.

9. A medium according to claim 6 wherein said coarsest ply comprises a perforated metal plate.

10. A medium according to claim 9 wherein said metal plate has an open area of 20 to 40 percent.

11. A medium according to claim 6 wherein said coarsest ply comprises a woven metal fabric.

12. A medium according to claim 2 wherein at least one ply of said medium has a pore size of 20 microns or less.

13. A medium according to claim 12 wherein said ply having said pore size of 20 microns or less is an outer ply of said medium and contacts a web during papermaking.

14. A drying medium having two opposed faces, said drying medium comprising a plurality of plies, a first ply, said first ply being disposed on one face of said medium, a ply comprising a perforated plate and a plurality of plies intermediate said first ply and said ply comprising said perforated plate, each of said plurality of intermediate plies comprising a weave having an unobstructed flow channel perpendicular to said intermediate plies.

15. A drying medium having two opposed faces, said drying medium comprising a plurality of plies, a first ply, said first ply being disposed on one face of said medium, a coarsest ply and a plurality of plies intermediate said first ply and said coarsest ply, each of said plurality of intermediate plies comprising a weave having an unobstructed flow channel perpendicular to said intermediate plies, said drying medium having a bending fatigue strength of at least 25 pounds per inch.

* * * * *